United States Patent [19]

Janovick et al.

[11] 4,325,421

[45] Apr. 20, 1982

[54] METHOD AND APPARATUS FOR CUTTING AND TRIMMING SHINGLES

[76] Inventors: Michael Janovick, P.O. Box 1444, Ladysmith, British Columbia, Canada, V0R 2E0; Donald F. Hammond, P.O. Box 975; Winston Harvey, both of Lake Cowichan, British Columbia, Canada, V0R 2G0

[21] Appl. No.: 98,941

[22] Filed: Nov. 30, 1979

[30] Foreign Application Priority Data

Dec. 5, 1978 [CA] Canada ..... 317403

[51] Int. Cl.[3] ..... B27C 9/00

[52] U.S. Cl. ..... 144/326 R; 83/210; 83/371; 144/13; 144/242 C; 144/245 R; 144/247; 198/624; 198/783

[58] Field of Search ..... 83/209, 210, 71, 72, 83/370, 371; 144/13, 43, 195, 193 J, 312, 326 R, 245 R, 246 R, 247, 242 C; 198/459, 624, 783

[56] References Cited

U.S. PATENT DOCUMENTS

| | | | |
|---|---|---|---|
| 3,429,416 | 2/1969 | Provost et al. | 198/459 |
| 3,754,586 | 8/1973 | Daniels | 144/13 |
| 3,776,290 | 12/1973 | Hughes | 144/326 R |
| 3,871,258 | 3/1975 | Hurn | 83/371 |
| 3,922,937 | 12/1975 | Maddox | 83/210 |
| 3,927,706 | 12/1975 | Davey | 144/245 R |
| 3,941,019 | 3/1976 | Baldwin et al. | 144/312 |

*Primary Examiner*—W. D. Bray

*Attorney, Agent, or Firm*—Stanley E. Johnson; Richard J. Hicks

[57] ABSTRACT

A method and apparatuses are disclosed for making shingles. The method consists of clampingly holding a block of material to be cut and conveying such block while it is clamped along a selected path through the clamping mechanism and causing relative movement between two cutting means which are inclined relative to one another to firstly cut a shingle from the block tapering in one direction and followed by a second shingle tapering in the opposite direction. The apparatus includes means for receiving and clampingly holding blocks as they are fed in sequence thereto and means to feed the block while it is clamped. The block is fed into the path of two cutting mechanisms and upon relative movement of the clamped block and the cutting mechanisms, the first cutting mechanism cuts first one shingle tapering in one direction and the second mechanism thence cuts a second shingle from the block tapering in an opposite direction, the cutting mechanisms being inclined relative to one another providing the appropriate taper for the shingles cut thereby from the block. The cut shingles are conveyed to an edge trimming apparatus and are moved by conveying means through at least one trimming station having cutting means for trimming the edges of the shingle. Upstream of the cutting means there is located a scanner that provides information to a computer that processes the information and actuates movement of the trimming saws to trim the edges of the shingle minimizing the amount of waste for each shingle. Defect cutting devices are also provided for removing defects in shingles and they too are controlled by information provided by the computer.

28 Claims, 14 Drawing Figures

METHOD AND APPARATUS FOR CUTTING AND TRIMMING SHINGLES

This invention relates to a method, apparatuses and combination of apparatuses for making shingles from logs of wood or blocks of material suitable for use as shingles.

Most shingle making systems utilized today require manually handling the rough cut shingles as they are cut from a block and further manual handling to trim the edges of the rough cut shingles. The operation is quite dangerous for the operators as they are standing closely adjacent two power driven circular saws rotating in planes perpendicular to one another. The saws are approximately 30 inches in diameter and the operator, by hand, grabs each individual rough shingle as it is severed from a block of wood by one saw and positions and feeds it to the other saw to trim the edges of the shingle. The operators fingers are closely adjacent one or the other of the two rotating saws and thus the operator must take extreme care so as not to lose a finger or two. In some areas, labour codes limit the number of shingles that can be handled per minute by each operator and this of course is for safety reasons to avoid fatigue, with resultant increased likelihood of possible accidents. In some regions the operators are limited to handling a maximum of thirty four shingles per minute, which for the operator is relatively fast, but from a productivity point of view is relatively low. The hand operation in manufacturing shingles is also wasteful as the operators, being mindful of their fingers, will waste more on an edge cut from a shingle than perhaps is necessary.

Attempts have been made by others to improve certain aspects of the operation in manufacturing shakes or shingles. One proposal is disclosed in Canadian Pat. No. 949,855, issued June 25, 1974, to John H. Hughes. In this patent ther is disclosed apparatus for making shakes and such apparatus consists of a feed mechanism mounted on a carriage that is reciprocably movable to feed a block thereon, to a revolving saw that is disposed in a fixed position. The feed mechanism tilts the blocks alternately first in one direction and then in another to cut shingles from the block, tapering first in one direction and then in a direction opposite thereto.

Another proposal is disclosed in Canadian Pat. No. 571,062, issued Feb. 24, 1959, to J. M. Copely, and which discloses apparatus for trimming edges of shingles. In this patent there is also briefly disclosed conveyor means for moving shingles flatwise, to and through a work station. In Canadian Pat. No. 478,270, there is disclosed another conveying means for transporting shingles to and through a shingle finishing station. Copies of the foregoing patents are attached hereto.

The foregoing references typically exemplify the fact that the prior proposals have been directed only to one or the other of the many different facets or operations in making shingles.

One object of the present invention is to provide an integrated system and apparatus for making shingles.

Another object of the present invention is to provide various novel apparatuses which may be used independently or in association with one another.

Another object of the present invention is to mechanize the operation in making shingles, to improve productivity and quality of shingle produced, while at the same time reduce waste.

In accordance with one aspect of the present invention, there is provided a method of making tapered shingles comprising: clampingly holding a block of material to be cut into shingles; conveying the block, while it is clamped, along a selected path through the clamping mechanism intermittently and in substantially equal increments, in the same direction, at each of opposite ends of the block; causing relative movement between a first cutting means and the clamped block to cut a first shingle from the leading face of the block tapering in thickness in one direction relative to the length of the shingle; and causing relative movement between a second cutting means and the clamped block to cut a second shingle from the block tapering in thickness in a direction opposite to that of the first shingle, said first and second cutting means cutting respectively along planes inclined relatively to one another and traversing the path of travel of the block.

In accordance with a further aspect of the present invention there is provided apparatus for trimming shingles comprising movably mounted cutting means, a scanner, means for conveying the shingles in sequence through the field of view of the scanner and along a selected path past the cutting means, computer means operatively associated with the scanner for receiving and processing information from the latter as to selected parameters associated with each shingle, and means oepratively associated with the cutting means to move the same in response to signals derived from the computer for appropriately cutting the shingle as they are conveyed along the selected path. Preferably there are first and second cutting means spaced apart from one another along the path of travel of the shingles, with the scanner located upstream of the first cutting means. The scanner provides information to the computer which determines the maximum width for each shingle, and imperfections in the shingles, such as the location of knot holes. The computer from such information provides signals to actuate the respective first and second cutting means, so that the shingles are cut to the maximum width permitted and the imperfections removed. Each of the first and second cutting means preferably comprise two cutting devices each movably mounted to move in directions transverse to the direction of travel of the shingle.

In accordance with a further aspect of the present invention there is provided a combination of the foregoing apparatus along with conveying systems whereby the blocks are first fed to the shingle cutting apparatus, and as they are cut in sequence, fed to the trimming apparatus.

In accordance with a further aspect of the present invention there is provided apparatus for conveying shingles flatwise and means associated therewith to align the shingles being conveyed to ensure that edge trimming of the shingle is squared with the butt end thereof said apparatus comprising at least one bar having a shingle engaging edge disposed perpendicular to the path of travel and movable along said path over a shingle supporting flat surface and means associated with said flat surface to impede sliding movement of the shingle thereover causing the butt end of the shingle to come into alignment with the edge of the bar as the shingle is pushed thereby along said path. In a preferred embodiment, the means impeding movement of the shingle on the flat surface consists of an aperture through to the flat shingle supporting surface (or a foraminous area on such surface) connected to a vacuum source.

In accordance with a still further aspect of the present invention there is provided apparatus for conveying and holding a workpiece comprising upper and lower spaced apart driven conveyors converging in a direction toward one another in the direction of feed of the workpiece (or alternatively other means to allow a block to freely enter the nip between the conveyors and then have clamping forces increase as the block proceeds to a cutting or the like work station) and means operatively associated with said conveyors to drive the same incrementally and in unison so that a workpiece clampingly engaged between the conveyors has its opposite ends moved in each increment a substantially identical amount.

The various aspects of applicants invention are illustrated by way of example in the accompanying drawings wherein.

Figure 6:
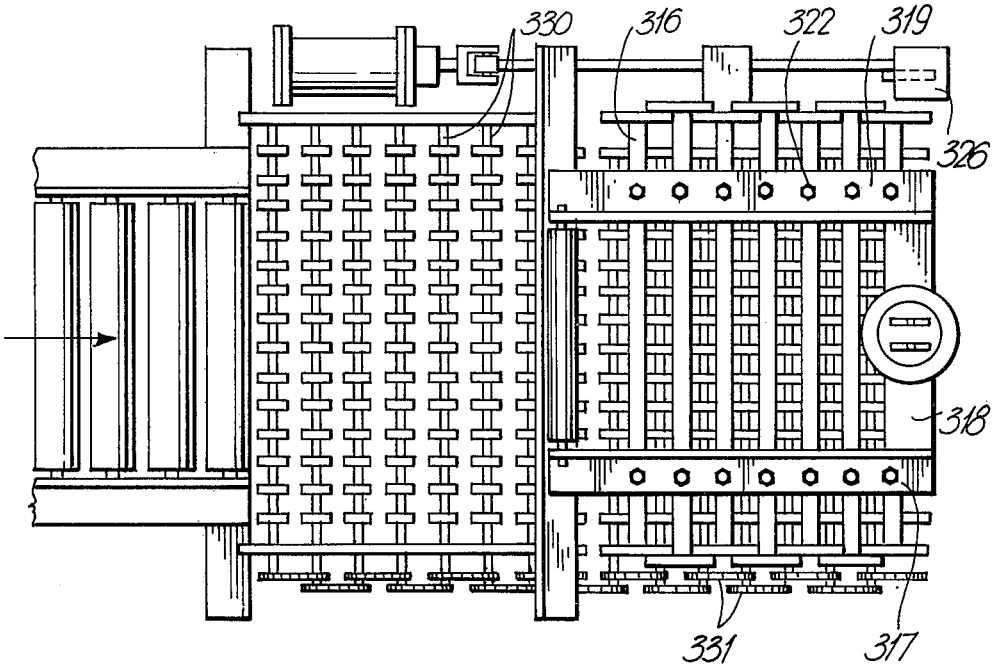
FIG. 6 is a top plan view of the block feed mechanism shown in FIGS. 3 and 4.
Figure 12:
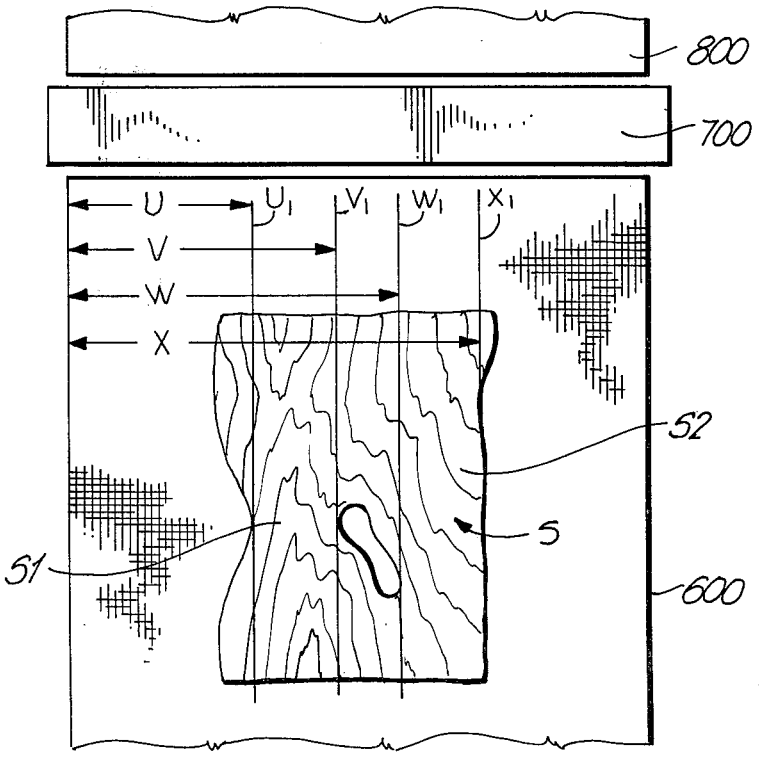
Figures 10, 13:
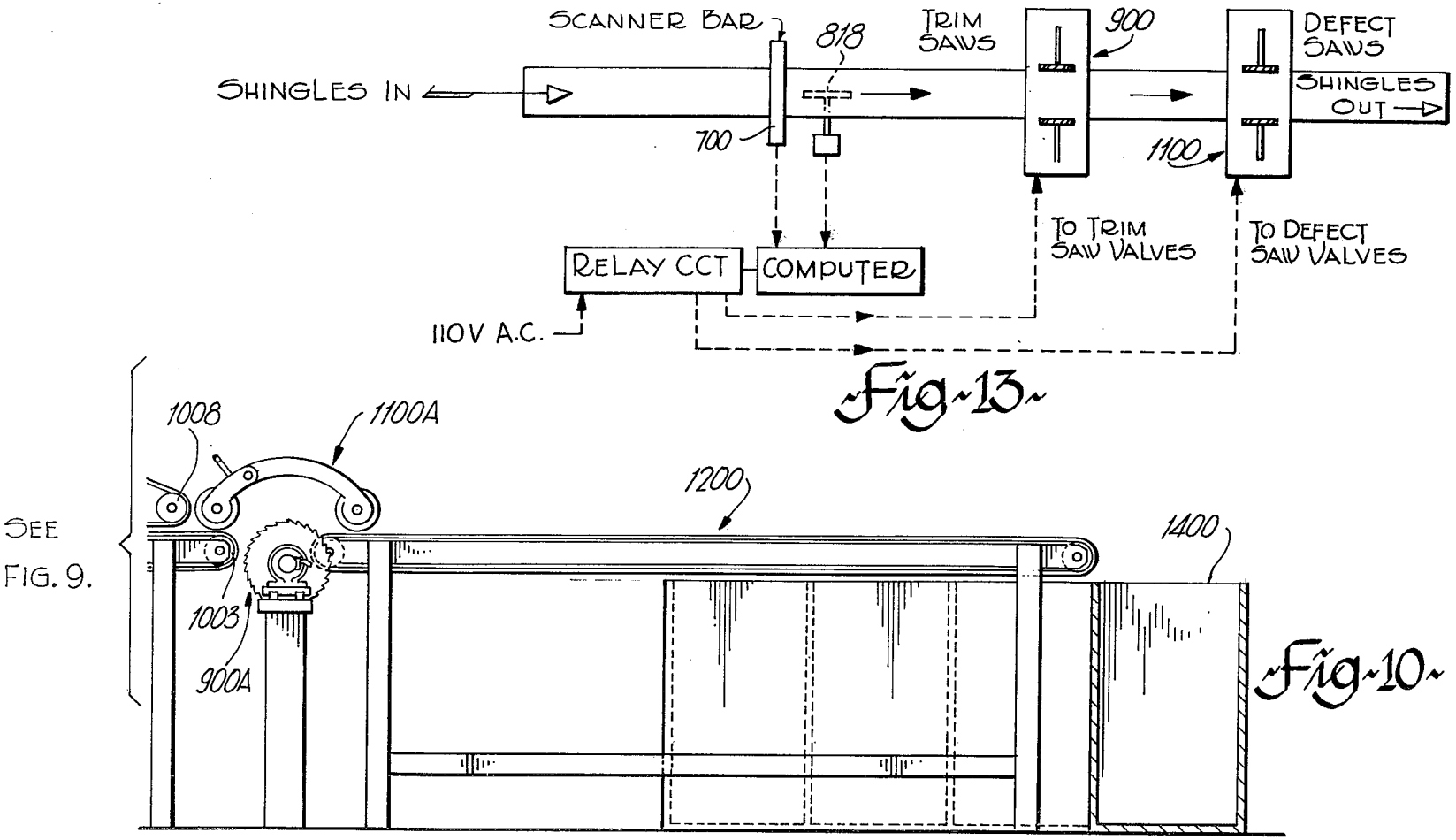
FIG. 10 is a continuation of FIG. 9, showing the remaining portion of the shingle trimming apparatus.
Figure 14:
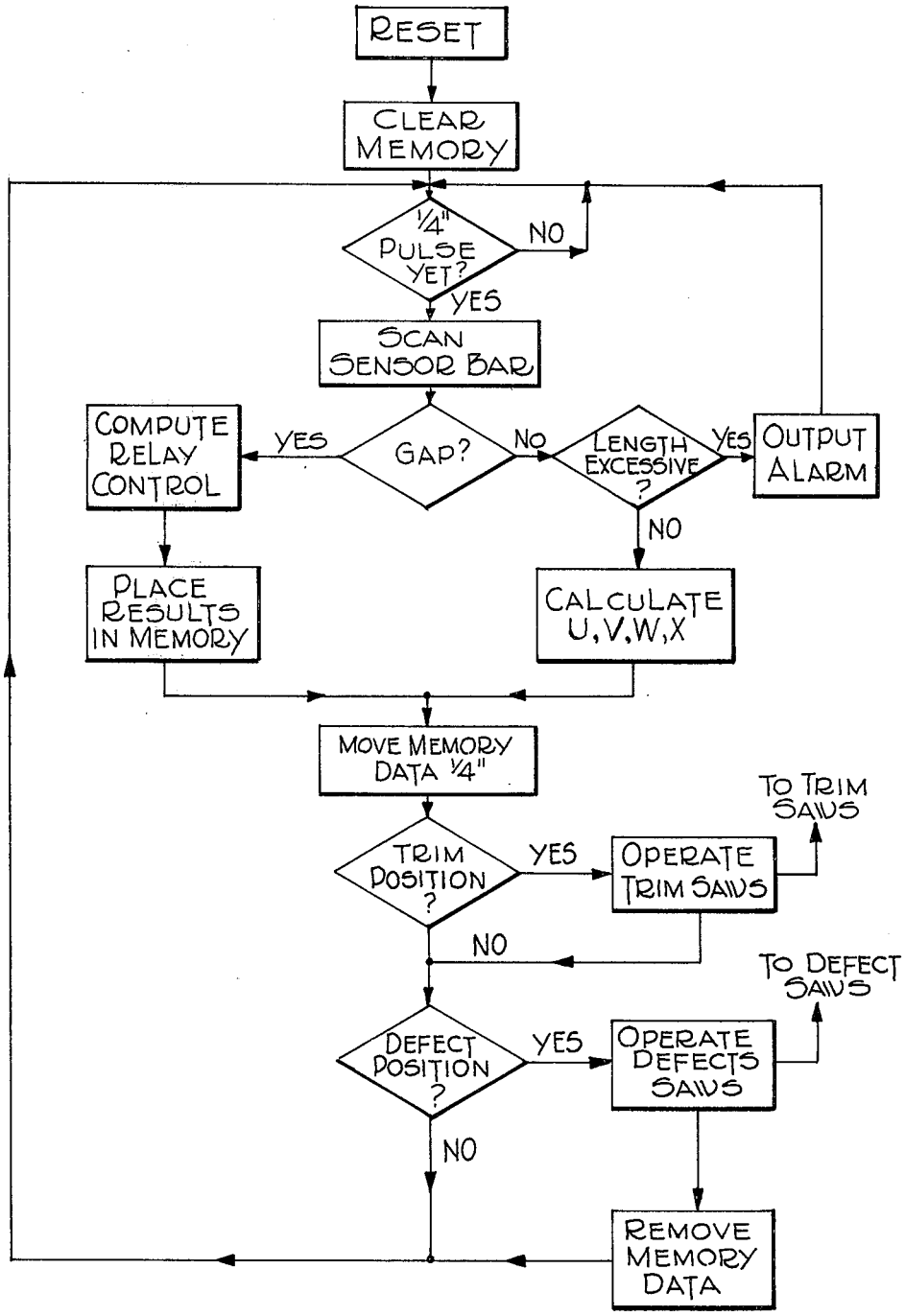

FIG. 12, appearing on the same sheet of drawings as FIG. 6, is a top plan diagrammatic view of the scanner illustrating the function of the same;

FIG. 13, appearing on the same sheet of drawings as FIG. 10, is a schematic of the sensing and computer control of the shingle trimming apparatus; and FIG. 14 is a schematic illustrating basic functions of the computer.

Figure 1:
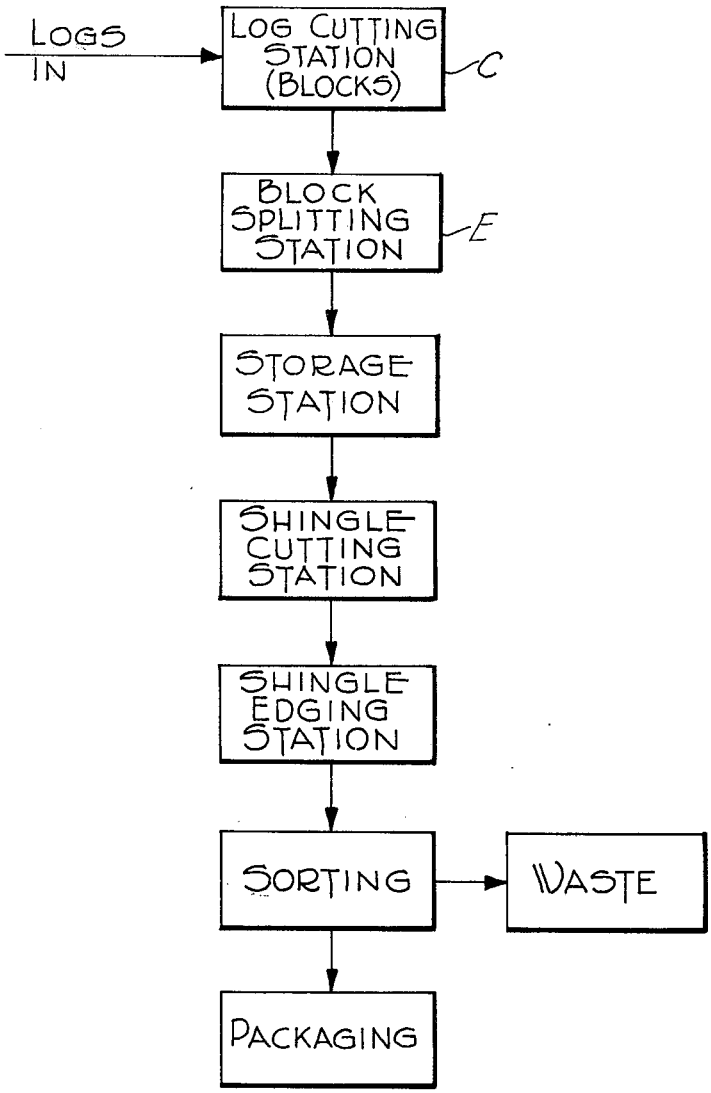
FIG. 1 is a block diagram illustrating schematically the overall shingle manufacturing process provided in accordance with one aspect of the present invention.

The overall process is diagrammatically illustrated in FIG. 1 and referring thereto the process in general consists of conveying logs to a log cutting station to sever the log into blocks of selected length. From the cutting station the logs are moved to a splitting station where they are split into appropriate size and/or shaped portions and/or relative to the grain for subsequently being cut into shingles. The split blocks are conveyed to a storing station from which they are fed by way of a conveyor to a shingle cutting station. The shingles from the shingle cutting station are conveyed to and through an edging or trimming station and the finished shingles are then sorted and those unsuitable for use passed on to waste or remanufacturing, while the remaining are packaged for shipment. The present invention concerns not only the overall process for making shingles, but also particular apparatus involving the shingle cutting station, the shingle edging or rimming station and the conveyors. As will be seen hereinafter, there is provided a novel conveyor apparatus for moving the split blocks incrementally and holding them while a novel cutting arrangement is utilzed to cut shingles in sequence from the leading face of the block fed thereto by the conveying system and a combination of such apparatuses. At the shingle edging station there is novel apparatus for edging the shingles which includes movably mounted cutting means operatively associated with a scanner and computer to detect and determine where cuts are necessary for edging and/or removing defects. The computer actuates movement of the cutting apparatus so that the shingle will be appropriately cut as it is moved along by conveying means. A novel conveying apparatus is also provided to align the shingles for trimming edges squared to the butt end of the shingle.

Figure 2:
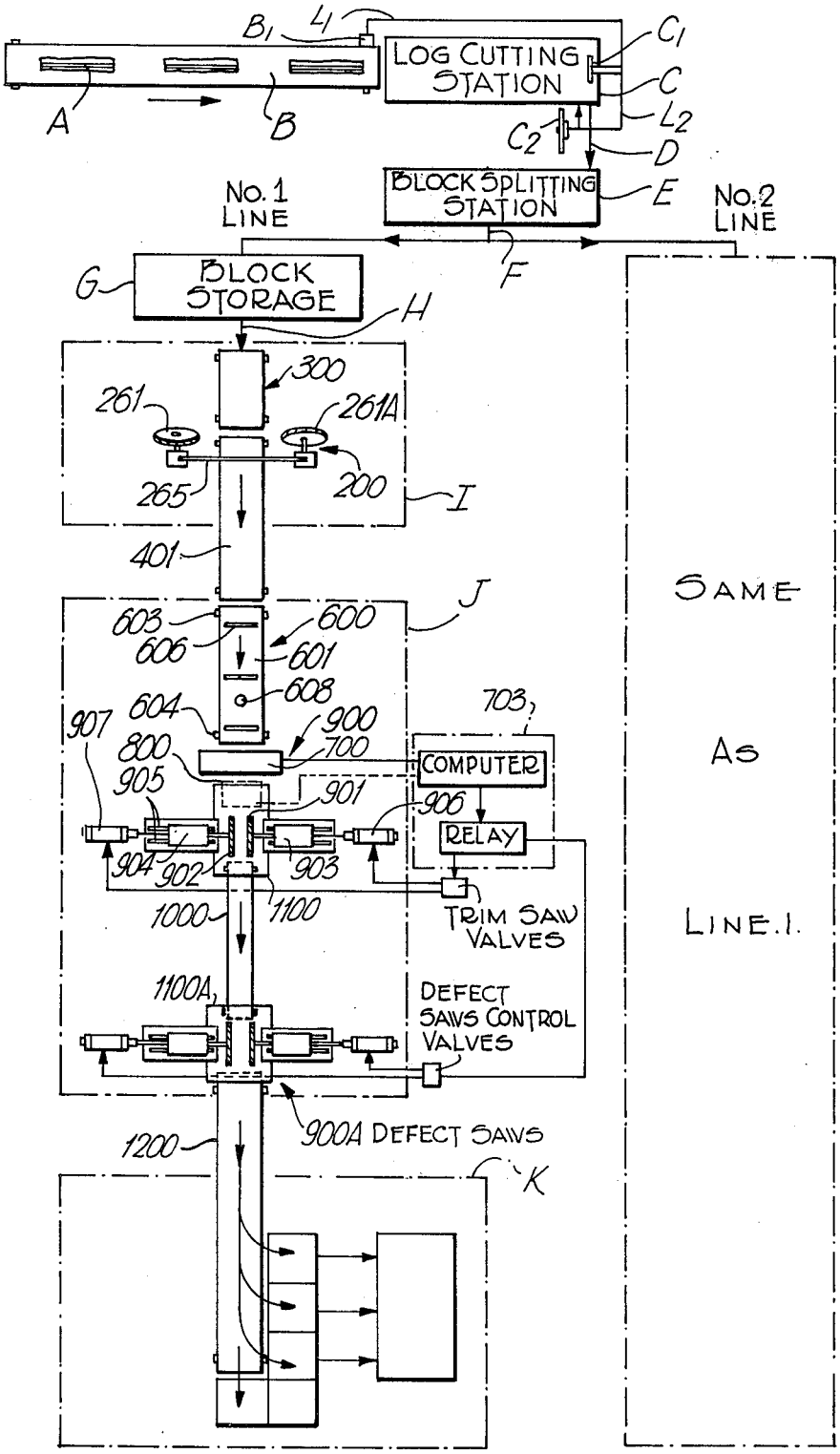
FIG. 2 is similar to FIG. 1 but diagrammatically includes therein certain parts of the apparatus provided in accordance with the present invention for making shingles.

Referring to FIG. 2, logs A are conveyed endwise by a conveyor B of any suitable form to a log cutting station C. At this station there is a stop mechanism C1 positioned relative to a log severing mechanism C2 to cut a block of preselected length from the leading end of the log and which determines the length of the shingles which normally are 16 inches or 18 inches. The stop C1 is operatively associated with the drive B1 of conveyor B to stop the same, and simultaneously therewith actuate operation of the cutting mechanism C2 to sever a block from the log and such operative inter-relationship is diagrammatically illustrated in FIG. 2 by respective lines L1 and L2. The blocks from station C are moved by way of a conveyor D to a block splitting station E and from there the split blocks are fed by way of a conveyor F to a block storage station G. From the block storage station G blocks are conveyed in sequence by a conveyor H to a processing line consisting of a shingle cutting station I followed by a shingle trimming station J, followed by a shingle sorting and bundling station K. There may be one or more processing lines each having thier own split block storing station G, or alternatively all processing lines may be supplied from a common storage station. The split blocks are cut into rough shingles at the shingle cutting station I, and the rough shingles therefrom are moved by a system of conveyors through the shingle edging or trimming apparatus identified by the reference J. The trimmed shingles pass therefrom to the grading and sorting station K where they are sorted as to quality and/or width into one of three or four different stations. Waste shingles are removed and those requiring remanufacturing are returned. Shingles suitable for use are packed into bundles of predetermined size for shipment.

SHINGLE CUTTING STATION

Details of various pieces of the apparatus of the shingle cutting station I are shown in FIGS. 3 to 9 inclusive, and referring now to these figures the shingle cutting station consists of a shingle cutting section 200 and a combined block clamping and index feed section 300. For convenience, the section 300 will hereinafter be referred to as the block feed and will be described in detail hereinafter.

The shingle cutting section (see FIGS. 3 and 8) consists of a rigid frame assembly 210, on which there is swingably mounted cutting mechanisms generally referred to by the reference numeral 250. The frame 210 has four corner posts 211 and on the top end thereof there is a rectangular peripheral frame consisting of side members or beams 212 and 213, interconnected at opposed at opposed ends by cross beams 214 and 215.

The cutting mechanisms 250 are swingably mounted on the upper frame oscillating two separate cutting devices back and forth in a path transverse to the direction of feed of blocks conveyed incrementally thereto by the block feed conveyor 300. The two cutting devices are designated in general respectively by reference numerals 251 and 252, and since they are substantially identical to one another, only one will be described in detail. The cutting devices are interconnected for swinging movement in timed relation so that cutting a shingle from the face of a block is first effected by one cutting device and then by the other as the frame oscillates back and forth.

The cutting device 252 consists of a pair of vertical rigid frame members 253 and 254, interconnected at the top by a cross bar 255 and at another position spaced downwardly therefrom by a further cross bar 256. The rigid frame consisting of uprights 253 and 254 and cross bars 255 and 256 is hung in a swingable manner from respective beams 212 and 213 by a pair of journals 257, and a shaft 258. The shaft 258 is secured to the respective uprights 253 and 254 and journalled for pivotal movement in the pair of aligned bearing blocks or journals 257. A second shaft 259 is journalled for rotation adjacent the lower end of respective members 253 and 254 by respective ones of a pair of bearing 260. Attached to one end of the shaft 259 is a circular saw blade 261 and on the opposite end a drive pulley 262. The saw blade 261 is driven by way of an electric motor 263 mounted on cross beam 255, the saw being driven by way of one or more V-belts 264.

The cutting device or unit 251 is substantially the same as that of 252 and thus will not be described other than to designate the circular saw thereof 261A, and also point out that it is driven to rotate in a direction opposite to that of saw blade 261. The saw blades 261 and 261A rotate in respective ones of two different planes that are tilted in directions opposite to one another corresponding to the amount of taper desired for each shingle.

The pair of cutting devices 251, 252 are interconnected by a pair of adjustable length link members 265, 266. The frame of cutting device 252 has a rigid arm 267 secured to cross bars 256 and 255 and projects upwardly from the latter. The projecting portion has a series of apertures 268 to receive a pivot pin 269 connecting one end of an adustable length link member 270 thereto. The link member 270 is associated with a drive mechanism that oscillates the frames back and forth about their respective mounting shafts 258.

The drive mechanism includes a motor 271, mounted on the peripheral frame by a suitable bracket, drivingly connected to a speed reducer 272 by way of a V-belt, or multiplicity of V-belts 273. The output shaft of the speed reducer, by way of the pulley 274 and V-belt 275 drives a crank arm 276 journalled on a bracket 277 secured to the frame. Link member 270 is pivotally attached to the arm 276 by way of a pivot pin 278.

From the foregoing it will be clearly evident drive motor 271, through the drive mechanism, will cause cutting devices 251 and 252 to oscillate back and forth and the amount of arcuate travel is determined by the location of pivot pin 269 relative to the pivot axis defined by shaft 258. Centering of the cutting devices for corresponding travel relative to the path of travel of blocks fed thereto by block feed 300 can be adjusted by the variable length link 270.

As will be seen hereinafter, a shingle is cut from a block first by saw 26 and then by the saw 26A (or vice versa). These saws are tilted relative to a vertical plane and in directions opposite to one another so that one saw will cut a shingle from the block tapering from one end towards the other, and the other saw will cut a similar tapered shingle but tapering in the opposite direction. This tilt of the respective saws in the opposite directions avoids the necessity of tilting the block to get a tapered shingle and permits utilizing apparatus that will securely hold the block while being cut.

Details of the block feed 300 are illustrated in FIGS. 3 to 7 inclusive, and referring to these figures there is illustrated respective upper and lower driven conveyors 301 and 302 driven in synchronism incrementally by driven means designated generally by the reference numeral 303. The upper and lower conveyors of the feed mechanism are mounted on a support frame 304 consisting of a weldment of members which are rigidly attached to the frame 210 of the shingle cutting section 200. The frame 304 has an upper portion 305 and a lower portion 306 interconnected by vertical straps 307. In addition to frames 210 and 304 being interconnected, the latter is provided with legs 308 to stabilize the entire structure.

Figure 3:
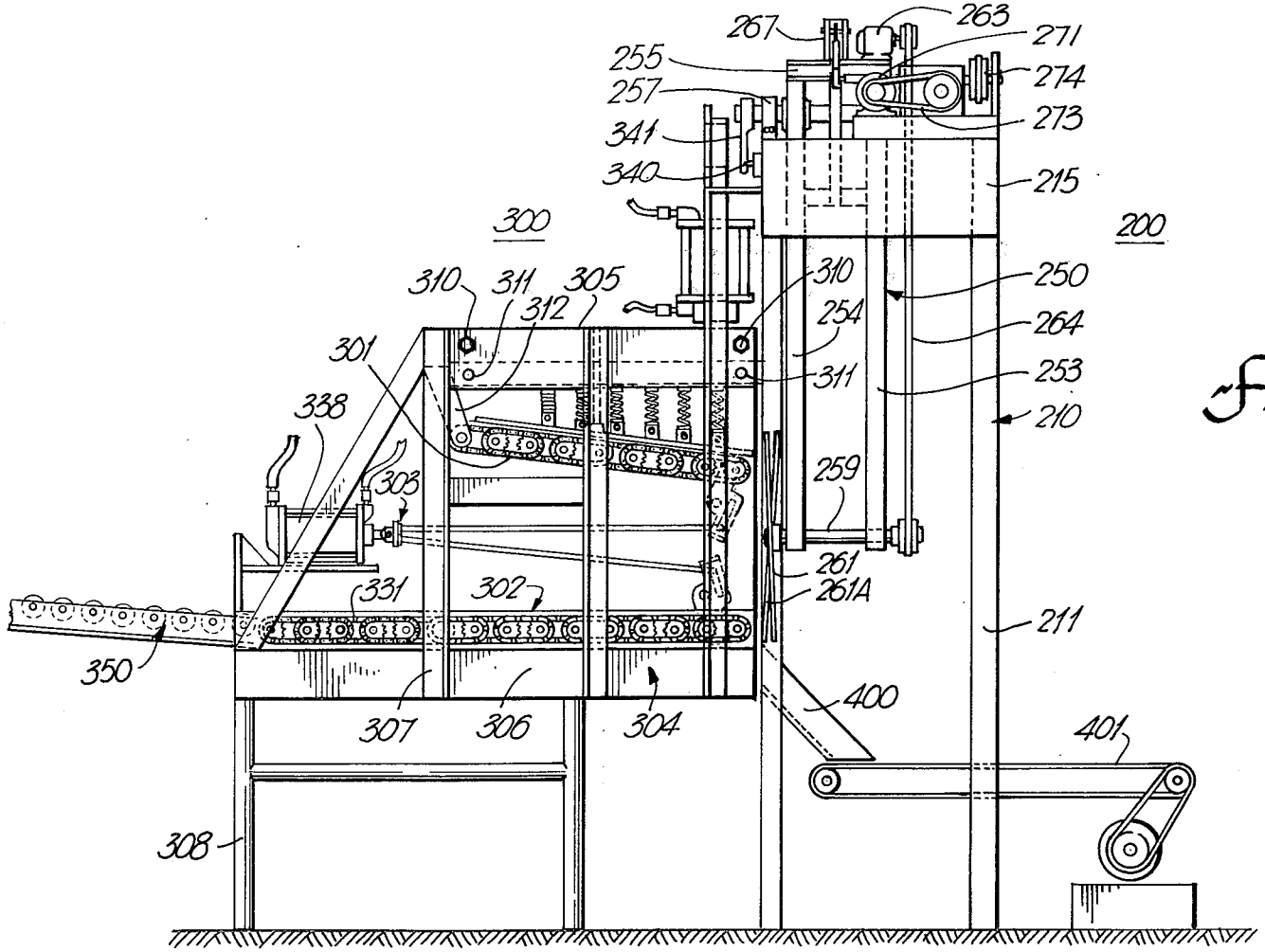
FIG. 3 is a side elevational view of a block feed and shingle cutting apparatus provided in accordance with the present invention.

The upper conveyor 301 has an outer frame 309 rigidly bolted to the upper frame 305 by bolt and nut assemblies 310, in either one of two different positions, depending on the length of block to be fed to the saws. FIG. 3 shows the upper conveyor in its lowermost position for 16 inch blocks and the frame 305 is provided with additional holes 311 to locate the conveyor in an upper position for receiving and conveying 18 inch blocks. These dimensions however may be varied depending upon the length of block utilized for making shingles.

Secured to and projecting downwardly from the frame 309 are a pair of arms 312, and journalled on these arms, adjacent the free end thereof, is a first roller 314A of a plurality of rollers 314 that constitute the upper conveyor. Additional rollers of the upper conveyor, downstream from the infeed and are designated respectively, 314B, C, D, etc. and the last of which is designated 314G. Opposite ends of each adjacent pair of rollers are interconnected by respective ones of a pair of links 315 and each pair of links are interconnected by a cross bar 316. Each cross bar 316 is connected to a rigid frame member consisting of interconnected angle members 317, 318 and 319, by a pair of guide bolts 320 coaxially disposed within compression springs 321. The guide bolts are attached to the bars 316 at one end and the opposite end passes through an aperture in respective ones of members 317 and 319 and retained in an assembled state with the spring under compression by way of nuts 322.

The rollers 314 interconnected by links 315, effectively form an articulated link conveyor and forces are applied thereto to clampingly engage the block between the upper and lower conveyor through the compression springs by a pneumatic or hydraulic cylinder unit 323. The cylinder of the hydraulic cylinder unit is fixed relative to the frame (304, 305, 210) and the piston rod end is connected to member 318 by way of the pivot pin 324. The bars 317 and 319, at the opposite end thereof relative to member 318, are pivotally attached to frame 309 by way of pivot pins 325.

The feed rollers 314 will be described in detail hereinafter, but at this point it will be mentioned that each shaft thereof has two sprockets fixed to one end thereof so as to be driven by roller chains looped around the sprockets of two adjacent rollers. The roller 314G, i.e., the furthest from the in-feed end of the conveyor, is driven by way of a one way clutch 326, mounted on the shaft of the roller. The clutch is preferably a ratchet type and has an arm 327 attached thereto with an elongate slot 328 therein which there is attached one end of a push rod 329. The attachment to the lever 327 is such that the push rod can pivot relative thereto and is adjustably positionable at any location longitudinally along the slot. This adjustment permits selectively varying the amount of incremental feed of the block and determines the thickness of shingle to be cut from the leading end of the block.

The lower conveyor 302 consists of a plurality of driven rollers 330, the last one of which, downstream from the in-feed end of the conveyor, is designated 330P. The rollers 330 are each journalled for rotation on the frame 304, and each adjacent pair are drivingly interconnected by a roller chain 331. The roller 330P is driven through a one way clutch 332, mounted on the shaft thereof, which is the same as the one way clutch 326 except for direction of drive. The one way clutch 332 has an arm 333 attached thereto and in which there is located an elongate slot 334. A push rod 335 has one end thereof attached to the arm 333 by way of the slot 334 and, as in previous case, is pivotal but selectively slidable and positionable at any position longitudinally along the slot.

The push rods 329 and 335 are attached by way of a pivot pin 336 to the piston rod 337 of an air or hydraulic cylinder unit 338. The cylinder unit 338 is double acting and reciprocation of the piston rod causes the rollers of the respective upper and lower conveyors to rotate counter to one another, moving a block clampingly engaged between the upper and lower conveyors in a direction to the right as viewed in FIG. 4. The block is moved incrementally by way of the ratchet clutches an amount corresponding to the thickness of shingle to be cut from the leading face of the block. Actuation of the air cylinder unit 338 is timed with the swinging movement of the cutting devices, by a switch 340 mounted on the saw supporting frame 212 (see FIG. 8). The switch 340 is operated by a lever 341 attached to shaft 258 mounting the saw unit 252 on the frame, and controls operation of valves for the fluid circuitry of cylinder unit 338 (or power actuator as it may also be called).

Figure 4:
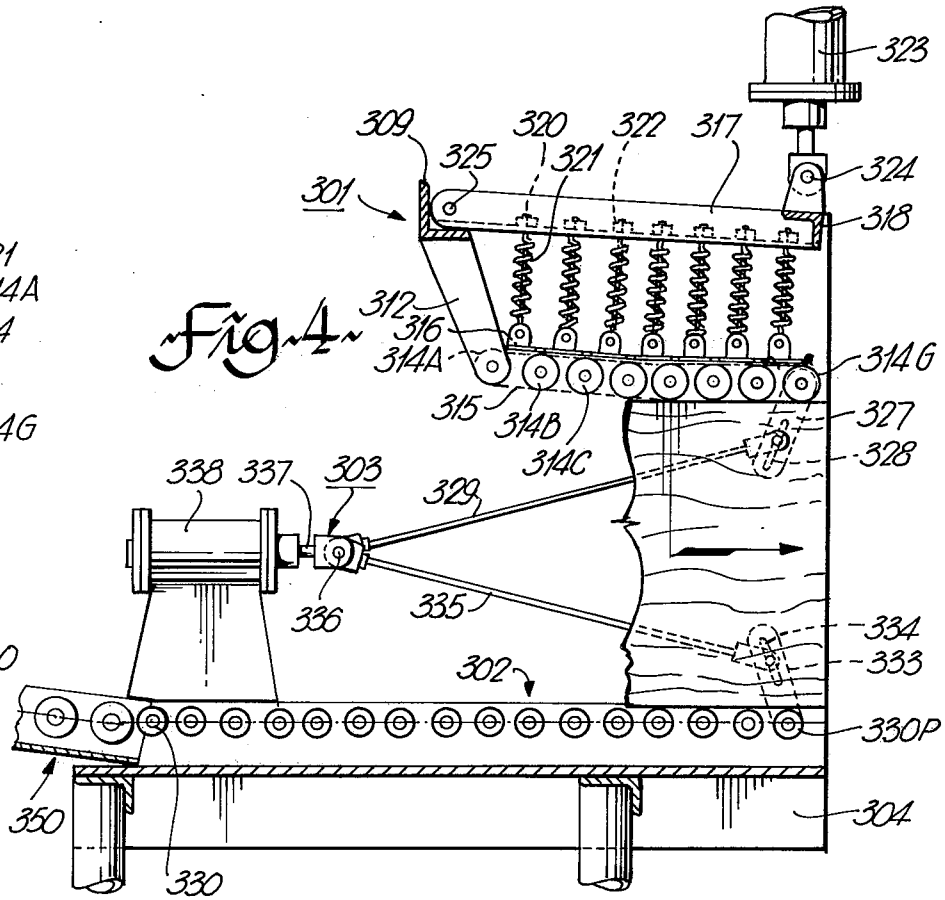
FIG. 4 is similar to FIG. 3, but with parts omitted or broken away to more clearly illustrate the feed mechanism.
Figure 5:
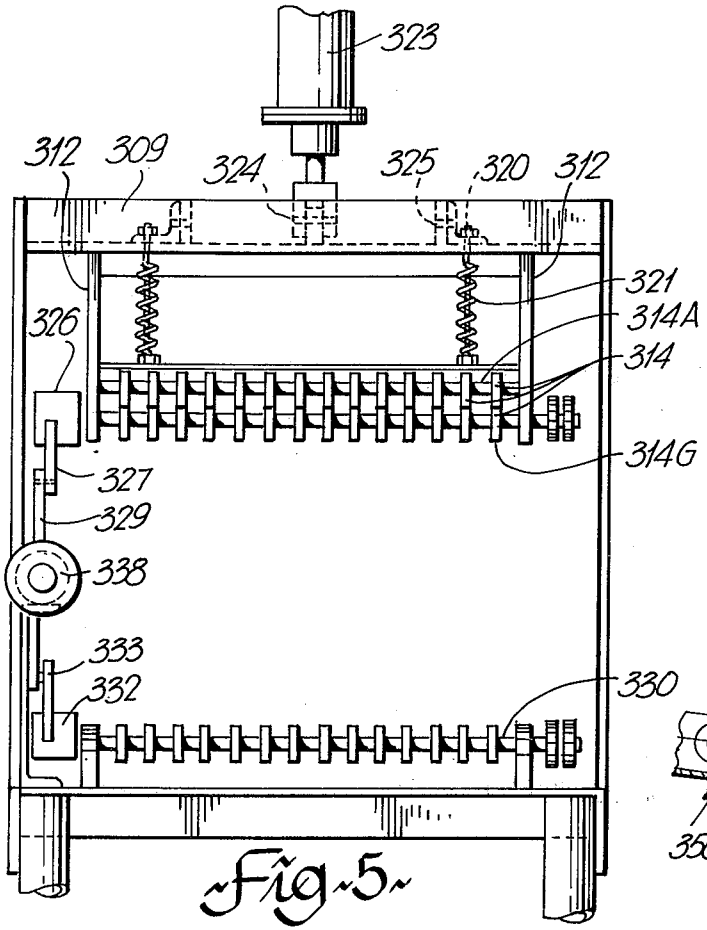
FIG. 5 is a front elevatinal view of the block feed mechanism shown in FIGS. 3 and 4.

From FIG. 4 it will be seen the lower conveyor 302 is longer than the upper conveyor 301. Blocks to be cut into shingles are fed to the lower conveyor by way of a gravity roller conveyor 350 after which they are moved to the right as viewed in FIG. 4 by the lower driven conveyor 302. The space between the upper and lower conveyor is such that at the in-feed end of the upper conveyor there is room for the block to be conveyed thereinto by the lower conveyor. These conveyors converge in a direction toward one another in the direction of feed and thus as the block moves progressively to the right (as viewed in FIG. 4) it is clampingly engaged between the upper and lower conveyors securely holding the block to withstanding forces applied thereto during cutting. The forces applying clamping pressure are applied by way of the pneumatic or hydraulic cylinder 323, which supplies a downward force on the frame (317, 318, 319) and which in turn, by way of compression springs 321 applies downward forces on the adjacent pair of rollers.

As previously mentioned and clearly illustrated in FIG. 3, the driven circular saw blades 261, 261A are tilted in opposite directions to one another relative to a vertical plane. In operation the block is fed in increments by the upper and lower conveyors by way of the drive mechanism and pneumatic or hydraulic cylinder 338. A first shingle will be cut for example by saw blade 261 as the frame swings to the left as viewed in FIG. 8, and on the return stroke, when the saw 261 is clear of the block, the block will be indexed forwardly by the conveyor for another shingle. As the frame swings further to the right as viewed in FIG. 8, another shingle will be cut from the leading face of the block by saw blade 261A. It will be readily apparent from this and the slope of the two saw blades that the shingle cut by the saw blade 261 will taper from one end to the other and the shingle cut by saw blade 261A will taper in the opposite direction.

Figure 7:
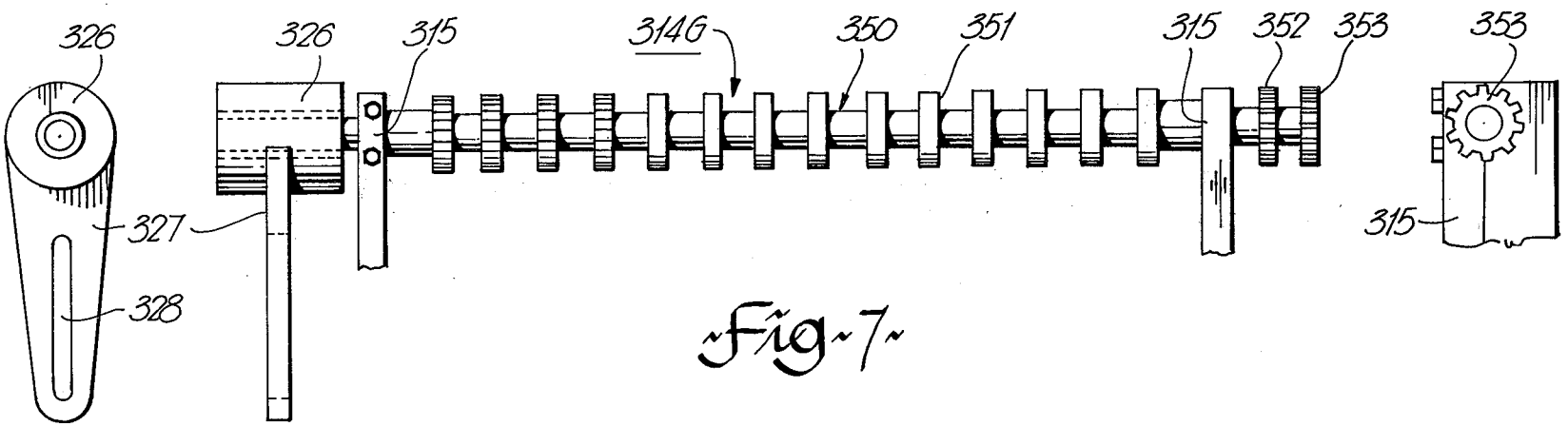
FIG. 7 is a detailed front and end views of one of the driven feed rollers of the block feed mechanism.
Figure 8:
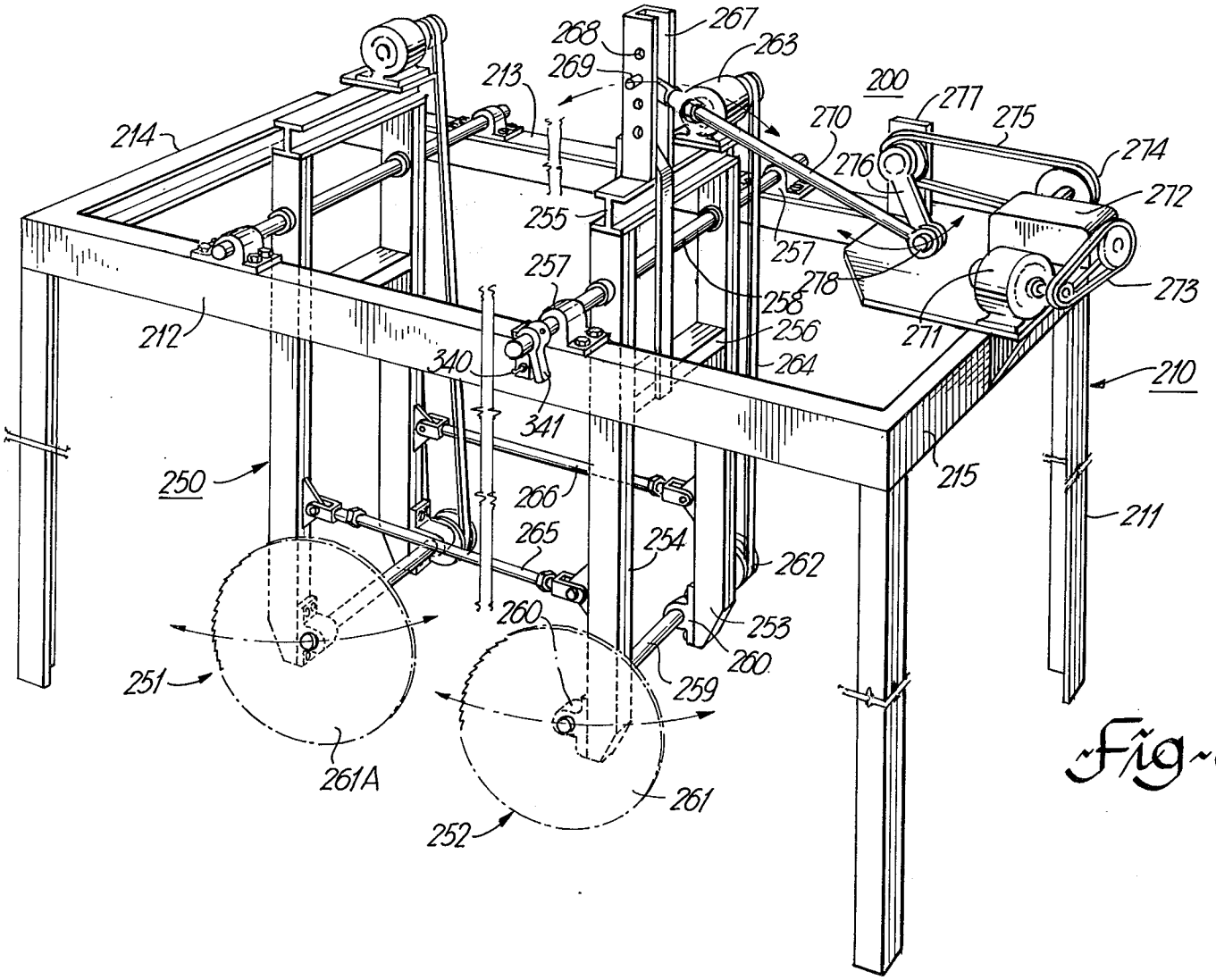
FIG. 8 is an oblique, broken view of the shingle cutting portion of the apparatus.
Figure 9:
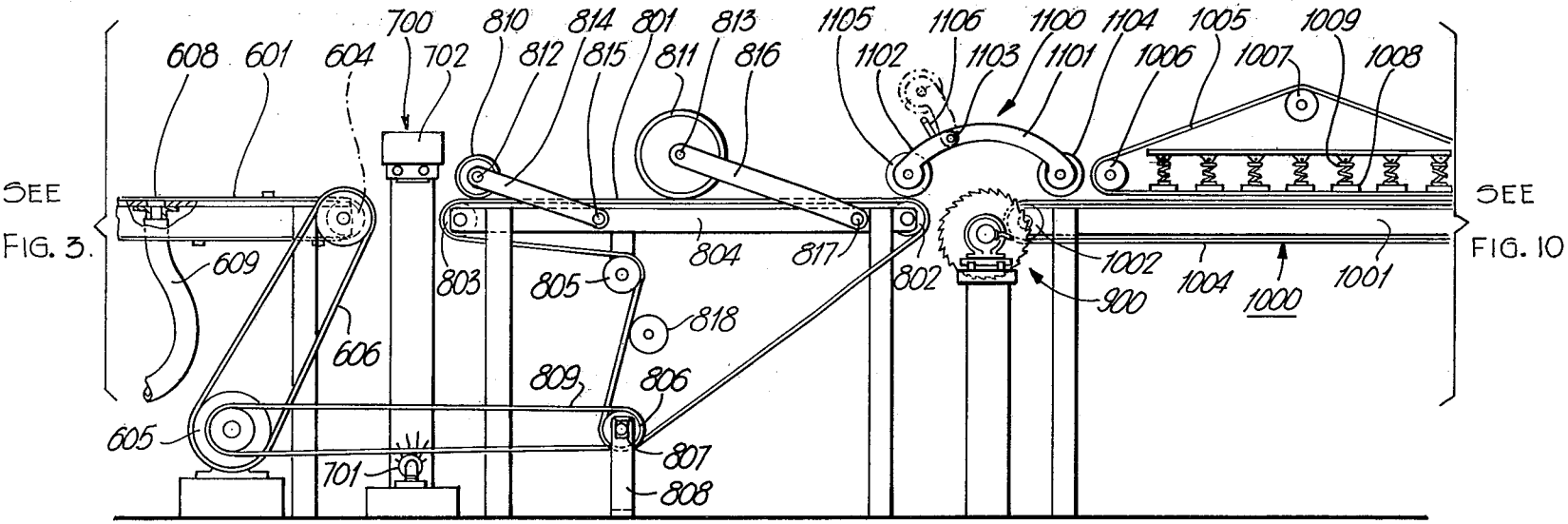
FIG. 9 is a side elevational view of the front portion of a shingle trimming apparatus provided in accordance with the present invention.

As far as the rollers of the upper and lower conveyors are concerned, attention is directed to FIG. 7 which illustrates feed roll 314G in detail. The feed roller has a shaft 350 on which there is mounted (or alternatively formed integrally therewith) a plurality of wheels 351 spaced apart from one another longitudinally along the shaft and secured thereto for rotation therewith. Each of the wheels 351 has a saw tooth periphery or other rough surface for tractively engaging a block to be propelled thereby. The shaft 350 is journalled for rotation at opposite ends thereof in respective ones of the pair of links 315 previously described that interconnect adjacent pairs of the driven rollers. One end of the shaft has a pair of sprockets 352 and 353 for rolling engagement with chains 331. One chain 331 is looped around a sprocket of each adjacent pair of rollers. From FIG. 6 it will be clearly seen that the double sprockets effectively provide two rows of link chains 331, there being a link chain drivingly interconnecting each adjacent pair of rollers throughout the length of the conveyor. The one way clutch 326 has a ratchet in the hub cooperating in a conventional manner with a notched drive wheel connected to the shaft 350.

SHINGLE TRIMMING STATION

The rough cut shingles from the shingle cutting station are guided by way of a downwardly inclined chute or trough 400, either into a collecting bin located in the proximity of the in-feed conveyor for the shingle edging section J, or alternatively onto a conveyor 401 which delivers them in sequence to the shingle trimming station J. The shingle trimming station consists of an infeed conveyor 600, a sensor 700 having a computer operatively associated therewith, a conveyor 800, a first shingle trimming section 900, which is followed by a conveyor 1000. A shingle hold down and assist conveyor 1100 is associated with adjacent ends of conveyors 800 and 1000 and the trimming section 900. Preferably there is also a second shingle trimming section 900A operatively associated with a second transfer and shingle hold down conveyor 1100A and which is followed by an outfeed conveyor 1200 that conveys the shingles to the shingle collecting and packaging station K.

Shingles from the conveyor 401 are deposited in sequence on the infeed conveyor 600 of the shingle edging station J with the thick butt end trailing in reference to the direction of travel of the infeed conveyor. Improperly oriented shingles can be detected and appropriately turned in many different ways. This function can be carried out manually or mechanically. For example, a shingle orientation detection means 402 can be associated with conveyor 401 and a shingle turning mechanism 403 to actuate the latter for appropriately turning improperly oriented shingles. The turning mechanism 403 can be a suction wheel, finger, turning plate or combination thereof, all of which are well known in the conveyor art.

Figure 11:
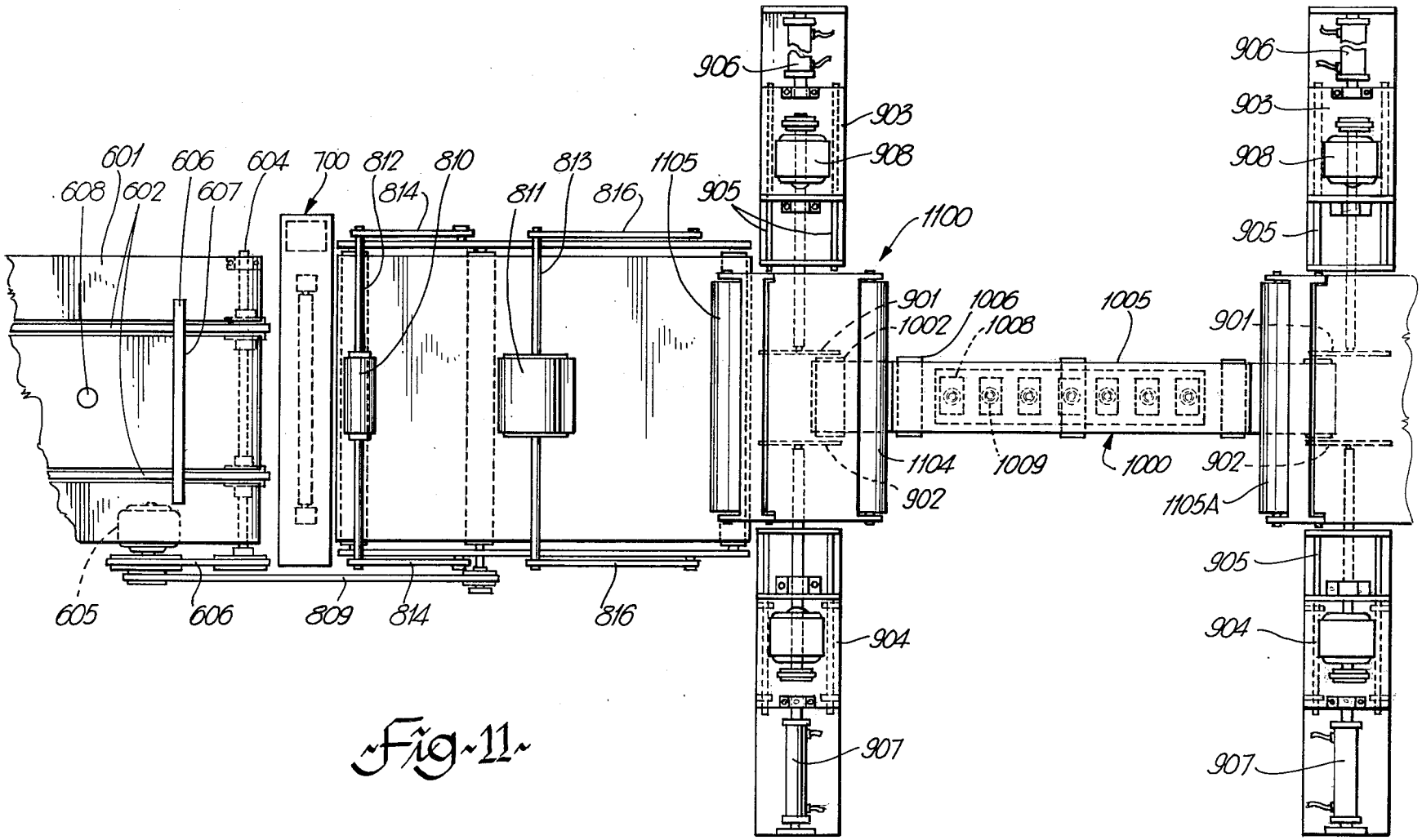
FIG. 11 is a top view of FIGS. 9 and 10 taken together.

The conveyor 600 (see FIGS. 2, 9 and 11) includes a table on which there is an upper flat surface 601, and over which bars of a bar conveyor move in the direction of the arrow as indicated in FIG. 2. The bar conveyor consists of a pair of endless chains 602 spaced apart from one another laterally across the table and which are looped around sprockets respectively on an idler shaft 603 and a driven shaft 604. Shaft 604 is driven by way of motor 605 through a drive belt 606. The laterally spaced chains 602 are interconnected by a plurality of bars 606 spaced apart from one another longitudinally along the length of the table and such bars have their leading face 607 disposed perpendicular to the direction of travel of the conveyor. The upper surface of the table top 601 has an aperture therein (or foraminous area) designated 608 and which by way of a conduit 609 is connected to a vacuum source. The vacuum source acts on a shingle passing thereover impeding movement of the shingle over the surface of the table top thus requiring additional force by bar 606 to move the shingle along the table surface. This additional force causes the butt end of the shingle to bear against the edge 607 of the bar, thus squaring the shingle for subsequent trimming ensuring that the edges of the shingle are perpendicular to the butt end. Other means of impeding movement of the shingles may be utilized, for example, a roughened surface on the table top, or material applied thereto, selected frictionally to impede the movement of the shingle so that if the shingle is askew relative to the direction of travel, it will be appropriately aligned for further processing by contact with the edge face 607 of the bar. By having the butt end of the shingle completely in contact with the edge face 607, the shingle is squared for trimming by saws or other cutting devices further downstream.

From the conveyor 600 the shingles pass onto conveyor 800 and in so doing traverse the field of view of a scanner 700 located therebetween. The scanner consists of a light source 701 and a detector section 702. The light source 701 consists of a plurality of incandescent bulbs located in alignment longitudinally across the path of travel of the shingle and at a position therebetween. The detector section has one or more sensors located above the path of travel of the shingle and is aligned with the light source. The shingles passing through between the light source 701 and detector 702 provide a signal to a computer 703 which controls actuation of the trimming sections downstream of the sensor.

FIG. 12 diagrammatically illustrates a shingle S being scanned and relative to a reference line T parallel to the direction of travel of the shingle. The scanner detects dimensions indicated as U, V, W and X. This information is fed to the computer 703 controlling movement of cutting devices further downstream, and from such information provides signals to cut along lines designated U1, X1, V1 and W1. Dimension U provides information as to the minimum amount which can be trimmed from one edge of the shingle and dimension X provides information as to the minimum amount which can be trimmed from the other edge of the shingle. Dimensions V and W provide information for removal of, for example, an open knot hole, subdividing the shingle S into shingles S1 and S2.

From conveyor 600 the shingles pass on to conveyor 800 which consists of an endless belt 801 looped around idlers 802 and 803 disposed respectively at opposite ends of a table support 804. An idler 805 is disposed below the table, as is also a driven roller 806 and the endless belt 801 is looped around these rollers. The driven roller 806 is mounted in journals 807 adjustably movable relative to a support 808 to tension the endless belt 801. Roller 806 is driven by way of the electric motor 605 through a V-belt 809.

Above the upper traverse of the endless belt 801, there are two idlers 810 and 811 journalled for rotation on respective shafts 812 and 813. The shaft 812 is disposed adjacent the free end of a pair of arms 814 pivotally attached at their opposite end to the table 804 by pivot pins 815. Similarly, shaft 813 is mounted adjacent the free end of a pair of arms 816 pivotally attached at their opposite end to the table 804 by pivot pin 817. The rollers 810 and 811 are hold down rollers ensuring the shingles to be trimmed are held in the same line of travels as the shingle moved when passing through the field of view of the scanner.

An idler wheel 818 is in rolling engagement with the inner face of the endless belt 801 and provides information to the computer as to the lineal speed of the belt, which in turn corresponds to the feed of the shingles to the trimming section. From the conveyor the shingles pass to the first trimming section 900 on to the conveyor 1000, and from there to the second trimming section 900A on to an out feed conveyor 1100. Bridging the gap between the conveyor 800 and conveyor 1000 and the gap between conveyor 1000 and conveyor 1100, are respective ones of a pair of hold down and assist conveyors designated respectively 1100 and 1100A.

Each trimming section 900 and 900A are the same and thus only one will be described herein. Trimming section 900 consists of a pair of power driven circular saws 901 and 902 mounted on respective ones of a pair of movable carriages 903 and 904. The carriages 903 and 904 are mounted on respective ones of a pair of parallel bars 905, for reciprocal movement in directions toward and away from the feed path of the conveyors, The carriages are reciprocably moved by respective ones of hydraulic or pneumatic piston cylinder assemblies 906 and 907, which move the respective saws 901 and 902 to an appropriate position as determined by the computer to trim the respective opposite outer edges of the shingle, removing minimal material as determined by the computer from signals obtained by the sensor. The edge cuts by saws 901 and 902 are determined by respective dimensions U and X as indicated in FIG. 12. Each saw 901 and 902 is a circular saw blade mounted on the end of a shaft journalled on the respective carriage and cantilevered therefrom, and drivingly connected to an electric motor 908 carried by the carriage associated therewith. The amount of reciprocable movement of the carriages determines the maximum and minimum width of a shingle and preferably are set to cut shingles to a minimum width of 3 or 4 inches and a maximum width of 18 inches. Of course, other dimensional limits may be utilized, depending on the amount of travel of the respective carriages and the size of shingles to be trimmed.

The second shingle trimming or cutting apparatus 900A is identical to that illustrated and described with reference to the shingle trimming section 900, and is controlled by the computer for movement as determined by dimensions V and W, to remove from the shingle an open knot hole or the like other defect as detected by the sensor, severing the edge trimmed shingle into two smaller shingles.

While the shingles are being trimmed by the saws at the respective cutting stations or trimmers, forces are applied to the shingle by the rotating saws and to counteract these forces there is the shingle hold down and assist conveyors 1100 and 1100A. These conveyors each consist of a first and second respective curved metal shrouds 1101 and 1102 hingedly interconnected by a pivot pin 1103. The shroud 1101 is fixed to a frame in relation to the other conveyors and has a power driven feed roll 1104 thereon extending transversely across the direction of travel of the shingle. The shroud 1102 has a power driven feed roll 1105 journalled on the free end thereof. A handle 1106 is provided on the shroud 1102 for lifting of same to provide access to the circular saws located thereunder, facilitating maintenance operations. The weight of the shroud 1102 and/or weight of the relatively heavy roller 1105 mounted thereon, keeps the latter in contact with the conveyor belt and/or presses a shingle thereon, holding the shingle in place and assists feeding the same in timed relation to movement of the conveyor while a saw trims the edeges of the shingle. Obviously, the shrouds and/or power driven rollers thereon may be spring loaded for appropriate pressural engagement with the respective conveyors and/or shingles thereon to hold shingles in position while they are being trimmed.

While circular saws are described and illustrated at each of the trimming stations 900 and 900A, other trimming devices may be utilized such as band saws, reciprocating saws or water jet or air jet cutting devices. Obviously, it is preferred to use a cutting device which applies minimum force to the shingle while cutting, reducing the forces required to hold the shingle in place while being cut, and/or ensuring the shingle does not become misaligned or offset from the path of travel followed by the shingle through the field of view of the detector.

Conveyor 1000 consists of a table 1001 having rollers 1002 and 1003 disposed respectively at opposite ends thereof. An endless conveyor belt 1004 is looped around the rollers and one of such rollers is driven by way of a V-belt from a line shaft to convey the shingles to the shingle defect cutting station 900A. Conveyor belt 1004 is relatively narrow (as is also conveyor belt 801) and the shingles are held thereon by an upper conveyor belt 1005 looped around rollers 1006, 1007 and 1008. The bottom traverse of conveyor belt 1005 is biased downwardly toward the upper traverse of belt 1004 by way of a plurality of foot plates 1008, spring loaded and biased downwardly as viewed in FIG. 9 by a plurality of compression springs 1009. The trimmed shingles are conveyed by conveyor 1200 to a collector container 1400, as seen in FIG. 10, or alternatively directed by appropriate means to one or the other of a plurality of tables where they are bundled, or in the case of rejects sent on to waste or redirected for recutting.

The general functioning of the scanning and trim section computer is illustrated in FIGS. 13 and 14 where the shingles are conveyed along the direction of arrow A through the view of the scanner onto the first set of trim saws 900 and then onto the defect saws 900A. Signals to the computer 703 are derived from the scanner 700 and the roto pulser 818. The information from these means is used to provide signals to actuate control valves for power units 906 and 907 to move the trim saws 900 and defect saws 900A, moving the carriages appropriately to trim the edges of the shingle and remove defects. FIGS. 13 and 14 are schematics illustrating the basic computer control function. The pulser 818 provides information to the computer as to the speed of travel of the shingles and with the distance of travel from the scanner to the respective saws 900 and 900A being known the time for actuating the saws can be determined by the computer. The scanner 700 provides information to the computer for each shingle travelling along the conveyor and the computer determines the location for each saw cut line U, V, W, and X, for each shingle which is stored in a memory and used to actuate movement of the trim saws and defect saws at an appropriate time for each of the respective shingles. The data from the memory is removed after being used permitting storing further data from succeeding shingles moved through the field of view of the scanner. Precise details of the computer components are believed unnecessary as stock items can be used and appropriately assembled by anyone skilled in computer technology.

We claim:

1. A method of making tapered shingles comprising:

(a) clampingly holding a block of material to be cut into shingles;

(b) conveying the block, while it is clamped, along a selected path through the clamping mechanism;

(c) causing relative movement between a first cutting means and the clamped block to cut a first shingle from the leading face of the block tapering in thickness in one direction relative to the length of the shingle; and (d) causing relative movement between a second cutting means and the clamped block to cut a second shingle from the block tapering in thickness in a direction opposite to that of the first shingle, said first and second cutting means cutting respectively along planes inclined relatively to one another and traversing the path of travel of the block.

2. A method as defined in claim 1 wherein said first and second cutting means are moved relative to the clamped block and in timed relation relative to one another to cut in sequence first and second shingles from the block.

3. A method as defined in claim 2 wherein the block is conveyed incrementally in steps in timed relation with the first and second cutting means, each incremental step corresponding to the thickness of shingle to be cut.

4. A method as defined in claim 1, wherein the first and second cutting means are caused to swing through arcs at spaced positions relative to one another and the clamped block.

5. A method as defined in claim 1 wherein the block is moved intermittently with substantially identical amounts of movement in the same direction at opposite ends of the block in each incremental movement.

6. Apparatus for cutting tapered blocks in sequence one after the other from blocks of material, comprising:

(a) means to receive and clampingly hold at least the leading block of a sequence of blocks;

(b) means to feed the clamped block along a selected path;
(c) first and second cutting means; and
(d) means mounting the clamped block and the first and second cutting means for relative movement along preselected paths to cut alternately first and second shingles by respectively said first and second cutting means, said first and second cutting means being arranged to cut in respective planes inclined relative to one another and thereby provide shingles tapering in thickness from one end to the other alternately in opposite directions relative to one another.

7. The apparatus of claim 6 wherein said block clamping and feed means comprises a pair of driven spaced apart conveyors drivingly engagable with respective opposite butt ends of the block and means to drive said pair of conveyors in synchronism.

8. The apparatus of claim 7 wherein said conveyors are inclined in a direction toward one another in the direction of movement of the block.

9. The apparatus of claim 7 wherein at least a portion of one of said conveyors is resiliently biased in a direction toward the other conveyor.

10. The apparatus of claim 7, wherein each of said conveyors comprise a plurality of driven rollers disposed parallel to one another and each having surfaces thereon tractively to engage the block.

11. The apparatus of claim 10 wherein each of the driven rollers have formations thereon tractively to engage the block, said formations comprising a plurality of toothed wheels on each of the rollers disposed at positions spaced apart from one another longitudinally therealong.

12. The apparatus of claim 7, wherein one of said conveyors has at least a portion of the rollers articuately interconnected for displacement of one roller relative to another in a direction toward and away from the other conveyor and wherein each of said displaceable rollers is resiliently biased in a direction toward the other conveyor.

13. The apparatus of claim 7, wherein said driven conveyors have infeed ends offset from one another in the direction of travel of the block.

14. The apparatus of claim 7 wherein said conveyors are adapted to progressively increasingly apply clamping forces to the block as it proceeds in its direction of travel toward the cutting means.

15. The apparatus of claim 6, wherein the feed and block clamping means include a pair of conveyors disposed vertically one above the other with the upper one having its infeed end offset from that of the lower one in the direction of travel of the block, wherein each of said conveyors comprise a plurality of rollers driven in synchronism with one anther and each roller has formations thereon for tractively engaging the block.

16. The apparatus of claim 6 including means mounting the cutting means for movement relative to the feed means to traverse the path travelled by the block.

17. The apparatus of claim 6 including means mounting the respective first and second cutting means to swing through arcs spaced apart from one another.

18. The apparatus of claim 6, wherein said first and second cutting means comprise driven circular saw blades spaced apart from one another and tilted respectively in opposite directions to cut the respective first and second shingles tapering in opposite directions relative to one another.

19. The apparatus of claim 18 wherein said circular saws are swingably mounted for movement through a pair of arcs spaced apart from one another and means interconnecting said swingably mounted saws to move in unison.

20. The apparatus of claim 18, wherein said saw blades are disposed in respective ones of two planes intersecting one another at the axis of rotation of the respective saws.

21. The apparatus of claim 7 wherein said feed means is driven to move the clamped block in increments and including means inter-relating the intermittent feed and movement of the respective cutting means to move the block and cutting means in timed relation for repeatedly cutting in sequency respective first and second shingles from the block

22. Apparatus for cutting blocks of wood of selected length into shingles and which shingles taper in thickness from one end to the other, comprising:
(a) means to clampingly hold the block while it is fed into a path traversed by cutting devices;
(b) means to feed said clamped block successively in increments corresponding to a preselected thickness of shingle desired to be cut from the block; and
(c) first and second cutting means movable alternatively along predetermined paths transverse to the direction of feed of the block for cutting shingles from the leading face of the block when it is fed in increments into the path of the cutting means, said first and second cutting means being inclined in opposite directions relative to one another for alternately cutting firstly a shingle tapering in thickness from one end to the other, followed secondly by a shingle tapering in thickness from one end to the other in the opposite direction.

23. The apparatus of claim 22 wherein said feed means comprises a pair of driven spaced apart conveyors drivingly engageable respectively with opposed butt ends of the block.

24. Apparatus for cutting tapered shingles from blocks of wood comprising means to clampingly hold a block and feed the clamped block incrementally into a path traversed by cutting devices, first and second cutting means movable alternately along predetermined paths across the direction of feed of the block for cutting shingles from the leading face of the block when it is fed in increments into the path of the cutting means, said first and second cutting means being inclined in opposite directions relative to one another for alternately cutting firstly a shingle tapering in thickness from one end to the other, followed secondly, by a shingle tapering in thickness from one end to the other in the opposite direction and means inter-relating the incremental feed and movement of the respective first and second cutting means along their respective paths.

25. The apparatus of claim 6, 22 or 24, in combination with means to trim the shingles, said trimming means comprising a movably mounted cutting means, a scanner, means for conveying the shingles in sequence through the field of view of the scanner and along a selected path past the cutting means, computer means operatively associated with the scanner for receiving and processing information from the latter as to selected parameters associated with each shingle, and means operatively associated with the cutting means to move the same in response to signals derived from the computer for appropriately cutting the shingles in accordance with such selected parameters as they are conveyed along the selected path.

26. Apparatus for conveying shingles flatwise and means associated therewith to align the shingles being conveyed to ensure edge trimming of the shingle is squared with the butt end of the shingle, said apparatus comprising a conveyor having bars each with a shingle engaging edge disposed perpendicular to the path of travel and movable along said path of travel over a shingle supporting flat surface and means on said shingle supporting flat surface, over which the shingles pass, impeding sliding movement of the shingle thereby causing the butt end of the shingle to come into alignment with said shingle engaging edge of the bar as it is pushed thereby over the movement impeding means.

27. Apparatus for trimming shingles comprising:

(a) shingle conveying means for moving shingles in sequence one after the other along a selected path;

(b) means associated with said shingle conveying means to orient the shingles such that the butt ends thereof are perpendicular to their respective paths of travel along said selected path, such shingle conveying means comprising a bar conveyor and wherein said shingle orienting means comprises means impeding movement of the shingles along a portion of the selected path of travel upstream of a scanner;

(c) a scanner having a field of view traversing said path to obtain information as to selected parameters of each shingle passing through such field of view;

(d) computer means operatively associated with said scanner for receiving the information obtained thereby and processing the same providing signals to actuate cutting means downstream of the scanner;

(e) cutting means located downstream of the scanner and mounted for movement in a direction perpendicular to the path of travel of the shingles; and (f) means to move said cutting means, said moving means being operatively associated with the computer for moving the cutting means to positions determined by the computer upon receipt of signals therefrom of each of the shingles moved along said path.

28. Apparatus for trimming shingles comprising:

(a) shingle conveying means for moving shingles in sequence one after the other along a selected path;

(b) means associated with said shingle conveying means to orient the shingles such that the butt ends thereof are perpendicular to their respective paths of travel along said selected path;

(c) a scanner having a field of view traversing said path to obtain information as to selected parameters of each shingle passing through such field of view;

(d) computer means operatively associated with said scanner for receiving the information obtained thereby and processing the same providing signals to actuate cutting means downstream of the scanner;

(e) cutting means comprising a pair of power driven cutting devices spaced apart from one another for trimming respectively opposed marginal edges of the shingles, said cutting means being located downstream of the scanner and mounted for movement in a direction perpendicular to the path of travel of the shingles; and (f) means to move said cutting means, said moving means being operatively associated with the computer for moving the cutting means to positions determined by the computer upon receipt of signals therefrom of each of the shingles moved along said path.

* * * * *